United States Patent [19]

Ward et al.

[11] Patent Number: 4,710,344

[45] Date of Patent: Dec. 1, 1987

[54] METHOD OF FORMING A GETTER ASSEMBLY

[75] Inventors: Thomas H. Ward, Bay Village; Phillip A. Costanzo, Parma; Vincent Pietrasz, Cleveland; Edmund J. Soeder, Parma Hts., all of Ohio

[73] Assignee: Union Carbide Corporation, Danbury, Conn.

[21] Appl. No.: 944,581

[22] Filed: Dec. 22, 1986

Related U.S. Application Data

[62] Division of Ser. No. 539,795, Oct. 7, 1983, Pat. No. 4,642,516.

[51] Int. Cl.[4] ..... B22F 7/04

[52] U.S. Cl. ..... 419/8; 419/66; 29/527.2

[58] Field of Search ..... 29/527.1, 527.2, 522 R; 264/56, 111; 313/481, 553, 561; 419/8, 48, 68, 66; 417/48, 51, 49

[56] References Cited

U.S. PATENT DOCUMENTS

| | | | |
|---|---|---|---|
| 2,447,434 | 8/1948 | Schwarzkopf | 419/68 |
| 2,464,437 | 3/1949 | Dasher | 419/8 X |
| 2,999,309 | 9/1961 | Kuzmick et al. | 419/48 X |
| 3,182,391 | 5/1965 | Charland et al. | 419/48 |
| 3,311,685 | 3/1967 | Forney et al. | 419/66 |
| 3,325,281 | 6/1967 | Ebhardt | 419/48 X |
| 3,428,168 | 2/1969 | Reash | 417/49 |
| 3,457,448 | 7/1969 | Scott | 313/481 X |
| 3,623,198 | 11/1971 | Held | 419/8 |
| 3,631,583 | 1/1972 | Haller | 419/48 |
| 4,128,782 | 12/1978 | Fransen et al. | 313/481 X |
| 4,225,805 | 7/1980 | Smithgall et al. | 313/481 |

FOREIGN PATENT DOCUMENTS

| | | | |
|---|---|---|---|
| 2033975 | 5/1980 | United Kingdom | 419/8 |

*Primary Examiner*—Charlie T. Moon

*Attorney, Agent, or Firm*—C. F. O'Brien

[57] ABSTRACT

Getter assembly having an annular channel for containing getter material, the bottom of the channel being provided with an annular, integral, groove of bulb-shaped cross-section extending into said channel to lock with said getter material.

1 Claim, 7 Drawing Figures

METHOD OF FORMING A GETTER ASSEMBLY

This application is a division of prior U.S. application Ser. No. 539,795 filing date 10/7,83, now U.S. Pat. No. 4,642,516.

The present invention relates to a getter assembly for use in vacuum tube applications such as television picture tubes and cathode ray tubes. More particularly, the present invention is directed to an improved channel ring type getter in which the problem of warping and lifting of the getter material during heating and flashing is avoided.

The use of getter materials in the manufacture of electronic tubes is well known. A commonly used getter construction consists of a container, such as an annular U-shaped receptacle, with the getter material pressed into the container. This assembly is mounted in a television picture tube usually by means of an "antenna" spring attached to the electron gun anode button or other internal parts of the vacuum tube. After the tube is evacuated, the residual gases left in the tube are removed by heating the getter container and material therein to a high temperature, suitably by induction heating, whereupon the getter material is flashed or vaporized. The vaporized getter material sorbs or reacts chemically with the residual gases and removes them as low vapor pressure solid condensates and continues to function in such manner with any further liberated gases throughout the life of the tube.

Usually the getter material principally comprises a mixture or alloy of metals such as, for example barium-aluminum intermetallic with nickel powder. It is the barium component of this mixture which provides the reactive material. The clean up of residual gases in the larger sized picture tubes or other cathode ray tubes, requires a relatively large amount of active barium material, for example, a yield of 200 to 300 mg. of barium with the total amount of gettering powder mixture in the container before flashing from 900 to 1500 mg.

A typical channel ring getter thus may contain 940 mg. of pressed getter material powder with a yield of vaporized barium of approximately 230 mg., i.e., 94% of the barium present in the powder alloy. The use of such large amounts of getter material has led to the use of wide channel getters, e.g. 0.15 inch or more between side walls, and such getters experienced warping and lifting of getter material during heating and flashing leading to the ejection of getter material into the tube and other types of getter failure.

A previous technique directed to this problem is disclosed in U.s. Pat. No. 3,428,168 which shows the use of metallic wire, flanges and crimped ridges as reinforcing members in an annular channel. The foregoing approaches have been beneficial however, especially with high barium yield getters, the increased mass of the getter resulting from the use of wire and flange reinforcements tends to increase the time required for flashing or require increased R.F. power while crimped ridges do not provide the most efficient "locking" configuration and cleaing e.g. degreasing of the channel after crimping does not completely remove impurities which could be released into the picture tube during "flashing". U.S. Pat. No. 3,457,448 also discloses a wire reinforcing member and the use of annular beads in the side wall of a getter container; the beads do not provide the most efficient "locking" configuration and location for getter material.

Accordingly it is an object of the present invention to provide a channel ring getter assembly which prevents warping and lifting of getter material during heating and flashing.

Other objects will be apparent from the following description and claims taken in conjunction with the drawing wherein FIG. 1(*a*) shows an elevation view in section of a getter assembly in accordance with the present invention, FIG. 1(*b*) is a plan view of the assembly of FIG. 1(*a*), FIG. 2 is an elevation view corresponding to FIG. 1(*a*) of the finished getter assembly of the present invention, FIG. 3 shows a getter assembly in accordance with the present invention after "flashing", FIG. 4 shows a getter assembly which is not in accordance with the present invention and which exhibits warping and lifting.

Figure 1A:
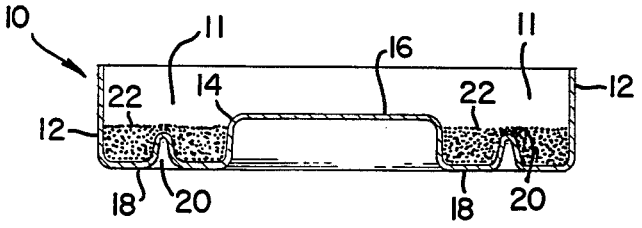
Figure 1B:
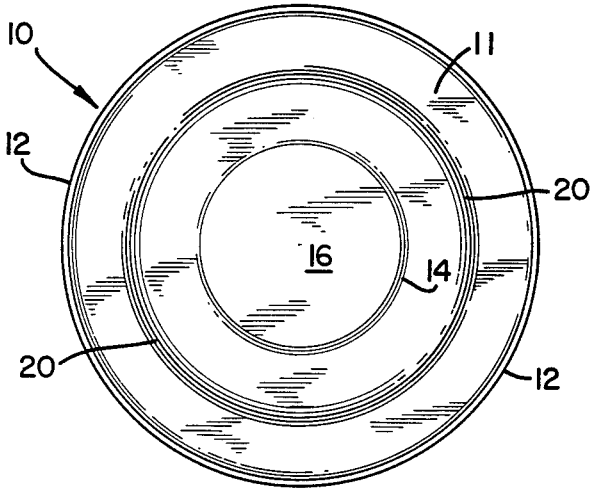
Figure 2:
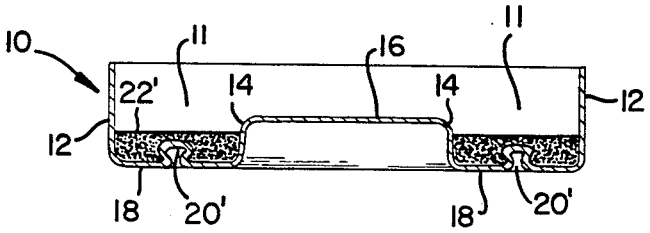

With reference to the drawing, FIG. 1(*a*) and FIG. 1(*b*) show a getter assembly in accordance with the present invention. A getter assembly is indicated at 10 comprising an annular channel 11 having outer and inner side walls 12 and 14, upraised center support member 16, and bottom member 18. Bottom member 18 has formed therein an annular groove 20 which extends upward into channel 11 and has a generally sinusoidal cross-section as shown. Powdered getter material 22 is placed in channel 11 covering the top of groove 20. The getter powder material 20 is then conventionally pressed into channel 11, e.g. at 15,000 to 45,000 psi, which densifies the powder as shown at 22' in FIG. 2 and deforms groove 20 to a generally bulb-shaped cross-section as indicated at 20' in FIG. 2 having a decreased narrower width adjacent the bottom member 18 of the getter channel. The bulb-shaped configuration of annular groove 20' efficiently interlocks with pressed getter material 22' and warping and lifting of the getter material during heating and flashing is avoided.

Further advantages of the present invention are as follows:

1. The getter assembly is manufactured at low cost by a straight forward die operation and can be completely and easily cleaned during degreasing.

2. Lower getter assembly weight is achieved by eliminating a seperate insert ring and less R.F. power to flash is required.

3. Less mass of the getter assembly will allow the getter to flash at faster starting times which would allow tube manufacturers to increase throughput.

4. Less mass of the getter assembly results in less deflecting load on "antenna" spring supports, minimizing contact with the surface coating of the picture tube.

5. Less mass, unitized construction and more surface contact with getter material promotes additional barium yield in the getter upon flashing.

6. Integral construction of the getter assembly eliminates the chance of misalignment of a separate insert and positive coupling to the R.F. field because of unitized construction thereby promoting less variation in barium yield from getter to getter.

7. Superior structural strength, as evidenced by less distortion and warpage after one or two getter flashes.

The present invention is applicable to both closed and open center type getter rings and is suitably made of stainless steel. Typically the channel will be from 0.1 to 0.2 inch wide and have one raised groove but may have additional raised grooves of the same or varied dimensions if greater strength, yield, or faster flashing time is required. The height of the groove can range from within 0.010" to 0.003" below the top surface of the getter fill material prior to pressing. The bottom side of the groove will have a typical opening of 0.010"±0.002" prior to final assembly. After pressing of the getter material the groove will be slightly rounded or bulb-shaped and its final height may vary between 0.008 to 0.020" (typically 0.015") below the getter fill. Typically the backside opening of the groove will close to varying degrees (non-hermetic) after final assembly depending on alloy pressing pressure. Getters were prepared using a standard production exothermic getter alloy powder by hand pressing at 30000 psi. Powder weight was 940±15 mg. twelve getters of each type (with, and without raised groove) were made and flashed. The getters were outgassed at 400° C. and $2\times10^{-5}$ Torr for one hour and vacuum cooled before flashing.

The specimens were selected for equal flashed barium yields. All 12 of the getters without raised grooves exhibited warping and lifting. Other failures, getter channel ring melting, were also observed on 8 of these specimens. None of the getters of this invention with raised grooves showed warping or any other flashing defect.

| Type | No. | RF | Barium Yield | Start Time |
|---|---|---|---|---|
| Without Raised | 4 | 1.20 | 233.25 ± 4.11 | 6.128 ± 0.15 |
| Groove | 4 | 1.15 | 233.75 ± 0.05 | 6.500 ± 0.16 |
| | 4 | 1.10 | 232.75 ± 1.26 | 7.075 ± 0.287 |
| This Invention | 4 | 1.20 | 231.50 ± 1.73 | 5.725 ± 0.236 |

-continued

| Type | No. | RF | Barium Yield | Start Time |
|---|---|---|---|---|
| | 4 | 1.15 | 228.75 ± 1.89 | 6.175 ± 0.222 |
| | 4 | 1.10 | 223.0 ± 2.94 | 6.625 ± 0.05 |

the flashing characteristics of these getters were:

| | Without raised groove | This invention |
|---|---|---|
| RF Power | 1.10 | 1.20 |
| Start Time (sec.) | 7.1 | 5.9 |
| Ba Yield (mg) | 233 | 233 |

Figure 3:
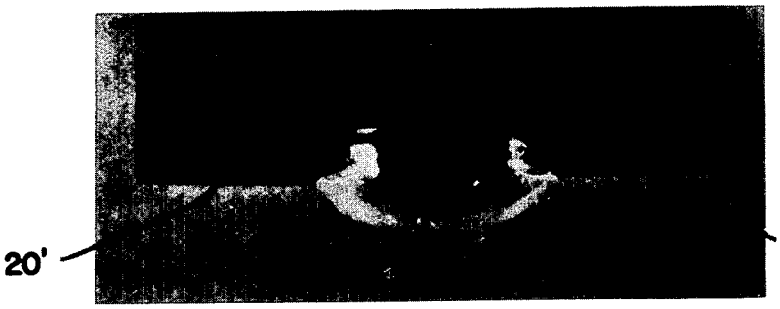

With reference to FIG. 3, the getter assembly shown therein is in accordance with the present invention and has been "flashed" without any warping of the getter material.

Figure 4:
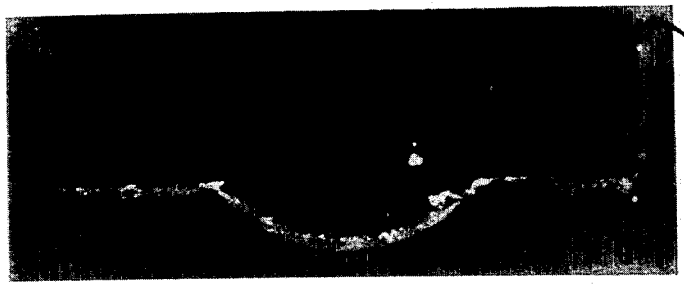

FIG. 4 shows a getter assembly which is the same as FIG. 3 except that no raised grooves were provided. On "flashing" this getter resulted in warping as indicated at 30.

Figure 5:
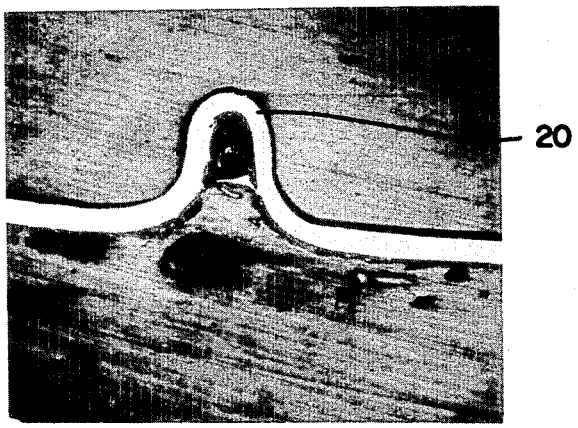
FIG. 5 is an elevational view in section of a getter assembly in accordance with the present invention prior to pressing-in of the getter material.
Figure 6:
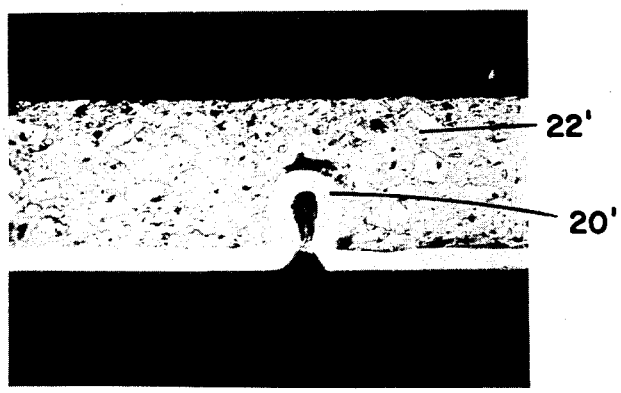
FIG. 6 is an elevational view in section of a getter assembly in accordance with the present invention after pressing-in of the getter material.

FIG. 5 shows a photograph (25.4X) of the raised groove of a getter assembly of the present invention prior to the pressing-in of getter material:

FIG. 6 shows the raised groove after pressing-in of the getter material.

What is claimed is:

1. A method of forming a getter assembly comprising:

providing a metal annular channel defined by outer and inner sidewalls and a bottom connecting said outer and inner walls, said bottom wall having an integrally formed annular groove having the general shape of half a sine period extending upwardly into said channel;

providing getter material into said annular channel to cover said annular groove; and pressing said getter material to deform said annular groove into a generally bulb-shaped cross section which narrows down adjacent said bottom wall, said annular groove thereby interlocking with the pressed getter material.

* * * * *